US012345469B2

(12) United States Patent
Kurtz et al.

(10) Patent No.: US 12,345,469 B2
(45) Date of Patent: Jul. 1, 2025

(54) AIR SEPARATION UNIT BY CRYOGENIC DISTILLATION

(71) Applicant: L'Air Liquide, Societe Anonyme pour l'Etude et l'Exploitation des Procedes Georges Claude, Paris (FR)

(72) Inventors: Remy Kurtz, Zhejiang (CN); Patrice Cavagne, Le Perreux sur Marne (FR); Delphine Vallier, Saint Pierre la Garenne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 18/221,509

(22) Filed: Jul. 13, 2023

(65) Prior Publication Data

US 2023/0358467 A1 Nov. 9, 2023

Related U.S. Application Data

(63) Continuation of application No. 16/962,823, filed as application No. PCT/CN2018/074328 on Jan. 26, 2018, now Pat. No. 11,740,015.

(51) Int. Cl.
*F25J 3/04* (2006.01)

(52) U.S. Cl.
CPC ..... *F25J 3/04412* (2013.01); *F25J 3/04878* (2013.01); *F25J 3/04678* (2013.01);
(Continued)

(58) Field of Classification Search
None
See application file for complete search history.

(56) References Cited

U.S. PATENT DOCUMENTS 3,596,471 A 8/1971 Streich
3,750,413 A 8/1973 Milligan et al.
(Continued)

FOREIGN PATENT DOCUMENTS

CN 101 782 309 7/2010
CN 101782309 A * 7/2010
(Continued)

OTHER PUBLICATIONS

International Search Report and Written Report for PCT/CN2018/074328, mailed Oct. 8, 2018.

*Primary Examiner* — Jianying C Atkisson
*Assistant Examiner* — Ibrahim A. Michael Adeniji
(74) *Attorney, Agent, or Firm* — Justin K. Murray

(57) ABSTRACT

An air separation unit using cryogenic distillation comprises a first column, a second column thermally linked to the first column, a first argon column, a second argon column, means for sending cooled, compressed and purified air to at least the first column, means for sending at least one fluid enriched in nitrogen from the first column to the second column and at least one fluid enriched in oxygen from the first column to the second column, means for sending a gas enriched in argon from the second column to a first end of the first argon column, means for sending gas from a second end of the first argon column to a first end of the second argon column, means for removing argon rich fluid from a second end of the second argon column, a pump, means for removing argon enriched liquid from the first end of the second argon column and sending it to the second end of the first argon column via the pump, the first end of the first argon column being raised above the ground by a first supporting structure, the pump being positioned within the first supporting structure, such that the pump is at least partially underneath the first end of the first argon column.

7 Claims, 2 Drawing Sheets

(52) U.S. Cl.
CPC ..... *F25J 3/04703* (2013.01); *F25J 2235/50* (2013.01); *F25J 2235/58* (2013.01)

(56) References Cited

U.S. PATENT DOCUMENTS

| | | | | |
|---|---|---|---|---|
| 5,049,173 | A | 9/1991 | Cormier, Sr. et al. | |
| 5,970,743 | A | 10/1999 | Herron et al. | |
| 2004/0000166 | A1 | 1/2004 | Moeller et al. | |
| 2010/0024478 | A1* | 2/2010 | Corduan ..... | F25J 3/04721 62/643 |
| 2015/0369535 | A1* | 12/2015 | Lochner ..... | F25J 3/04654 62/644 |
| 2020/0333070 | A1 | 10/2020 | Zheng et al. | |

FOREIGN PATENT DOCUMENTS

| | | |
|---|---|---|
| CN | 201 803 570 | 4/2011 |
| CN | 201803570 U * | 4/2011 |
| CN | 202 229 526 | 5/2012 |
| CN | 105 020 979 | 11/2015 |
| DE | 197 37 520 | 3/1999 |
| EP | 1 103 772 | 5/2001 |
| FR | 2 964 451 | 3/2012 |
| WO | WO 2014 169989 | 10/2014 |

* cited by examiner

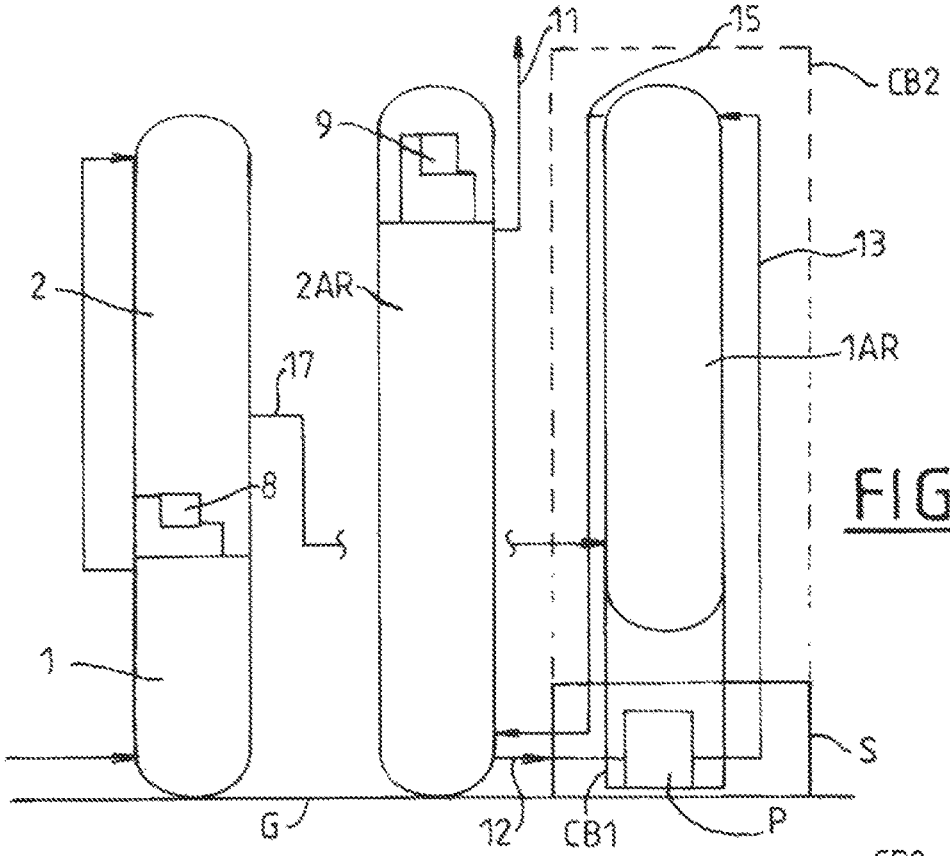
FIG.1
FIG.2
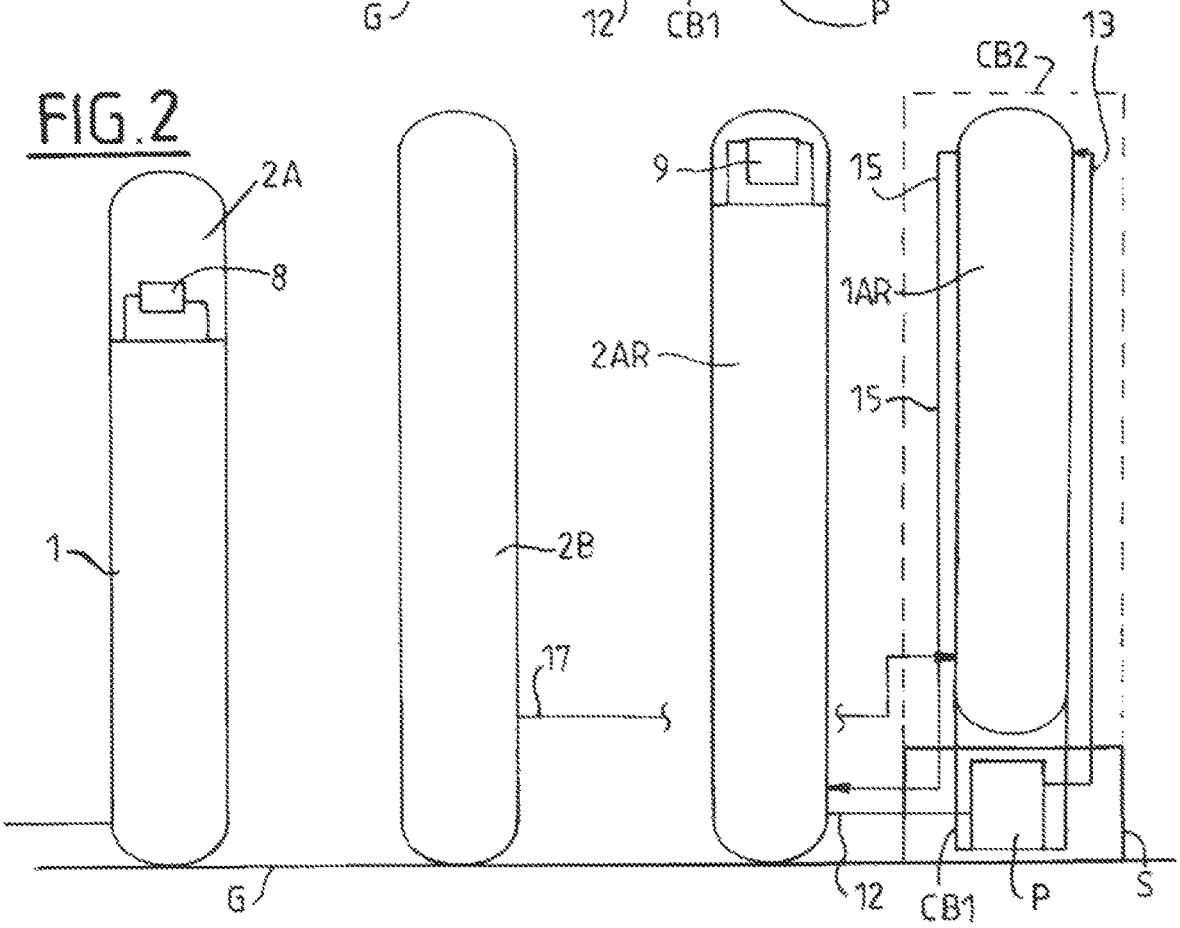

AIR SEPARATION UNIT BY CRYOGENIC DISTILLATION

CROSS REFERENCE TO RELATED APPLICATIONS

The present application is a continuation application of U.S. application Ser. No. 16/962,823, filed Jul. 16, 2020, which is a § 371 of International PCT Application PCT/CN2018/074328, filed Jan. 26, 2018, both of which are herein incorporated by reference in their entireties.

TECHNICAL FIELD OF THE INVENTION

The present invention relates to an air separation unit using cryogenic distillation.

BACKGROUND OF THE INVENTION

In order to produce argon from air, it is well known to separate air by cryogenic distillation in a double column, comprising a first column operating at a first pressure and a second column, thermally coupled to the first column, operating at a second pressure lower than the first pressure. Argon is then produced from a stream enriched in argon as compared to air withdrawn from the second column.

Air that has been compressed, purified and cooled to a cryogenic temperature is sent to at least the first column where it separates to form an oxygen enriched liquid at the bottom of the first column and nitrogen enriched fluid at the top of that column.

The oxygen enriched liquid is generally sent in part to the second column and for the rest is used for cooling.

To produce argon, an argon enriched stream is produced from the second column at an intermediate point. This stream is then sent to the first of two argon columns, connected in series. The first argon column separates the argon enriched stream to produce a gas further enriched in argon at the top of the column and this gas is sent to the bottom of the second argon column in order to produce an argon rich stream at the top of the second argon column. The condenser at the top of the second argon column is cooled using the rest of the argon enriched liquid from the bottom of the first column.

Liquid from the bottom of the second argon column is sent back to the top of the first argon column using a pump.

A typical illustration of this set-up is to be found in EP1103772 where the first column is positioned between the low pressure column and the second column and the pump for sending the liquid from the bottom of the second column to the top of the first column is positioned close to the bottom of the second column.

US2010/0024478 shows an argon column in one section. It is not clear whether the figure actually reflects the real positions of the elements of the plant.

It is in addition generally recommended by pump manufacturers to place the pump as close as possible to the source of liquid to be pumped.

SUMMARY OF THE INVENTION

It is an object of certain embodiments of the present invention to provide a more compact solution for the air separation plant in terms of ground space occupied by the plant or "footprint", and potentially to make the argon columns easier to transport and install on site.

According to an object of the invention, there is provided an air separation unit by cryogenic distillation comprising a first column, a second column thermally linked to the first column, a first argon column, a second argon column, means for sending cooled, compressed and purified air to at least the first column, means for sending at least one fluid enriched in nitrogen from the first column to the second column and at least one fluid enriched in oxygen from the first column to the second column, means for sending a gas enriched in argon from the second column to a first end of the first argon column, means for sending gas from a second end of the first argon column to a first end of the second argon column, means for removing argon rich fluid from a second end of the second argon column, a pump, means for removing argon enriched liquid from the first end of the second argon column and sending it to the second end of the first argon column via the pump, characterized in that the first end of the first argon column is raised above the ground by a first supporting structure, the pump being positioned within the first supporting structure, preferably entirely within the supporting structure such that the pump is at least partially underneath the first end of the first argon column.

According to Further Optional Features:

- the pump is contained within a first insulated enclosure and the first argon column is contained within a second insulated enclosure.
- the first insulated enclosure is at least partially underneath the first argon column and/or at least partially underneath the second insulated enclosure.
- all of the first insulated enclosure is underneath the first argon column and/or underneath the second insulated enclosure.
- the first insulated enclosure is contained at least partially within the first supporting structure, preferably entirely within the first supporting structure.
- the first end of the second argon column is raised above the ground by a second supporting structure or by the first supporting structure.
- the first end of the second argon column is at a lower or higher level above the ground that the first end of the first argon column or at the same level.
- the second end of the second argon column is at a lower or higher level above the ground that the second end of the first argon column or at the same level.
- the first supporting structure supports no column other than the first argon column.
- the first insulated structure is contained partially within first supporting structure and partially within the second supporting structure.
- the unit comprises a pump motor connected to the pump and positioned within the first supporting structure, preferably entirely within the first supporting structure.
- the first argon column does not contain means for reboiling or condensing fluid from the column.
- the second argon column is positioned between the first argon column and the second column.
- the second argon column is positioned between the first argon column and the first column.
- the second argon column comprises a condenser for condensing gas from the second end of the second argon column.
- the length of the first argon column is between 80% and 120% of the length of the second argon column.
- the first and second columns form a single structure, the entire second column being positioned above the first column.
- the first column is underneath the second column.

the first and second columns are positioned side by side.

part of the second column is positioned above the first column and the rest of the second column is positioned beside the first column.

the pump inlet is connected so as to receive liquid to be pumped only from the second argon column.

at least the greater part of the pump volume and preferably also of the pump motor volume is/are located in the space formed between the bottom of the first argon column and the ground, directly underneath the bottom of the first argon column.

the pump is entirely located directly underneath the bottom of the first argon column.

the pump motor is entirely located directly underneath the bottom of the first argon column.

only part of the first insulated enclosure is located directly underneath the bottom of the second argon column.

no part of the first insulated enclosure is located directly underneath the bottom of the second argon column.

According to the present invention, there is also provided a process for constructing an air separation unit comprising erecting a first column, a second column thermally linked to the first column, a first argon column and a second argon column, providing means for sending cooled, compressed and purified air to at least the first column, providing means for sending at least one fluid enriched in nitrogen from the first column to the second column and at least one fluid enriched in oxygen from the first column to the second column, providing means for sending a gas enriched in argon from the second column to a first end of the first argon column, providing means for sending gas from a second end of the first argon column to a first end of the second argon column, providing means for removing argon rich fluid from a second end of the second argon column, providing a pump, providing means for removing argon enriched liquid from the first end of the second argon column and sending it to the second end of the first argon column via the pump, characterized in that it comprises erecting a first supporting structure for the first end of the first argon column such that the first end of the first argon column is raised above the ground and placing a pump within the first supporting structure directly underneath the first end of the first argon column.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims or the way in which said claims refer back to one another.

FIGS. 1, 2, 3A and 3C show air separation units according to certain embodiments of the invention.

DETAILED DESCRIPTION OF THE INVENTION

Figure 3A:
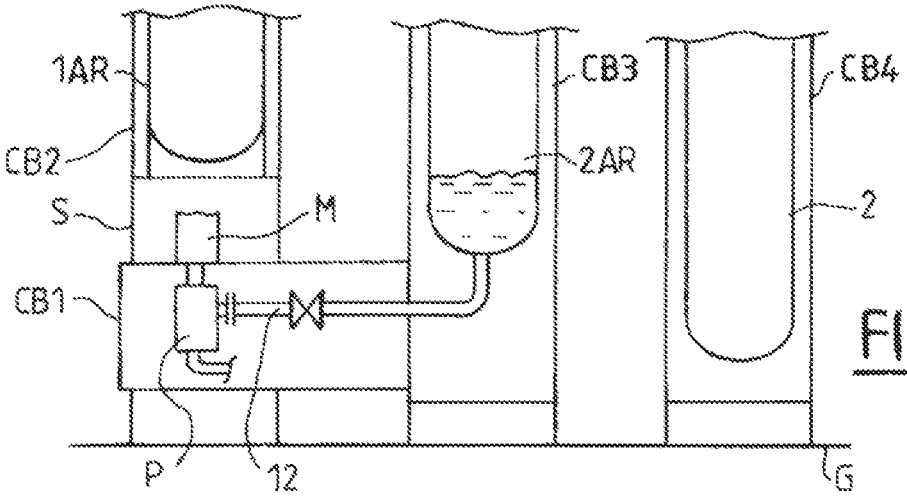

In FIG. 1, cooled, compressed and purified air is sent from a heat exchanger (not shown) to a first column operating at a first pressure in which it is separated. An oxygen enriched liquid (not shown) is sent from the bottom of the first column to the middle of a second column, operating at a second pressure, lower than the first pressure. A nitrogen enriched liquid (not shown) is sent from the top of the first column to the top of the second column. An oxygen rich fluid may be removed from the bottom of the second column which includes a bottom reboiler 8 heated using top nitrogen gas from the first column. Other methods of thermal integration can be used. For simplicity only the insulated enclosures CB1 and CB2 are shown.

The second column is positioned on top of the first column in the figure but the two columns may be positioned side by side.

A first argon column 1AR having neither reboiler nor condenser and a second argon column 2AR having a top reboiler 9 complete the columns of the air separation unit, though other columns may exist. The first and second argon columns 1AR, 2AR operate substantially at the same pressure as the second column. The length of the first argon column may be between 80% and 120% of the length of the second argon column.

The second argon column is positioned between the first argon column and the low pressure column. Preferably, the double column 1, 2, the second argon column and first argon column are positioned in a straight line.

The first argon column is fed by an argon enriched gas stream 17 coming from the second column 2. Preferably, no part of this stream is sent directly to the second argon column. The argon enriched gas is enriched in argon to form a gas 15 richer in argon than gas 17. The gas 15 is sent from the top end of the first column to the bottom end of the second column.

An argon rich gas or liquid 11 is removed from the top of the second argon column, under the top reboiler 9. The top reboiler is cooled using part of the oxygen enriched liquid from the bottom of column 1.

An argon enriched liquid 12 is removed from the bottom of the second argon column 2AR and sent to the first argon column 1AR, within a supporting structure S serving to support the first argon column 1AR several meters above ground level G. From there it passes inside insulated enclosure CB1.

Positioned within the supporting structure S, the insulated enclosure CB1 contains a pump P, valves, and conduits for sending liquid to and from the pump. This enclosure is known as the pump casing. The liquid 12 is sent into insulated enclosure CB1 where it is pressurized by pump P, removed from insulated enclosure CB1 and sent to insulated enclosure CB2 which contains the first argon column 1AR. The pumped liquid 13 is sent to the top of first argon column 1AR. Thus, the pressurization of the liquid 12 by pump P must be sufficient to overcome the hydrostatic pressure due to the height of the first argon column 1AR.

The insulated enclosure CB1 may protrude slightly from the supporting structure such that only part of the insulated enclosure CB1 is directly underneath the insulated enclosure CB2 and/or directly underneath the first argon column 1AR.

In addition, part of the volume of the pump P and/or part of the volume of the pump motor M may not be located directly underneath the insulated enclosure CB2 and/or directly underneath the first argon column 1AR.

Obviously the greater the volume of the first insulated enclosure CB1 underneath the second insulated enclosure CB2 and/or directly underneath the first argon column 1AR, the greater the overall reduction in footprint.

The length of the first argon column 1AR is between 80% and 120% of the length of the second argon column 2AR.

In FIG. 2, the argon columns 1AR and 2AR are identical to those of FIG. 1 but the double column made up of the first column 1 and second column 2 is made of a first structure comprising the first column 1 and a bottom section 2A of the second column 2. The top section 2B of the second column 2 is positioned alongside the first structure and feeds argon enriched gas to the first argon column 1AR. For simplicity only the insulated enclosures CB1 and CB2 are shown.

Figure 3B:
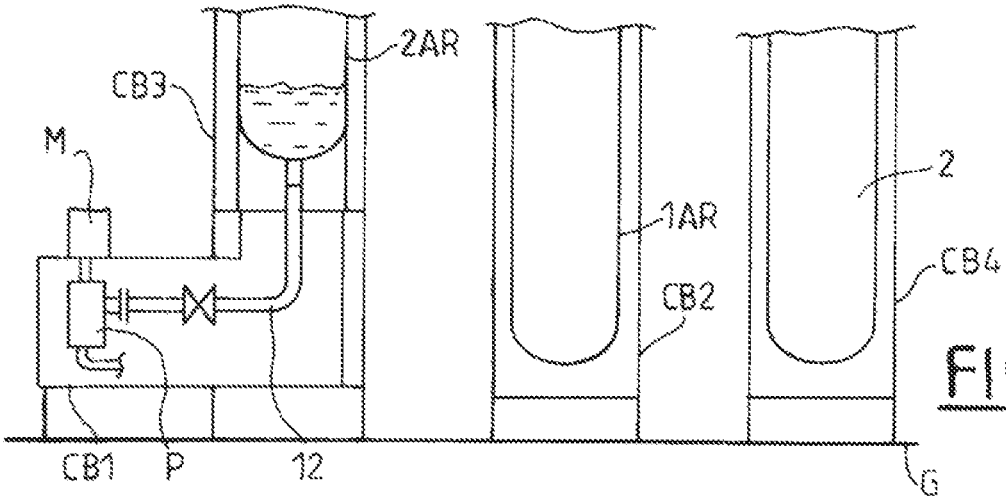
FIG. 3B shows a comparative example.

FIG. 3 aims to show in greater detail the bottoms of the columns shown in FIG. 2. The columns are shown as first argon column 1AR on the left, second argon column 2AR in the middle and second column 2 on the right for FIG. 3A according to the invention. FIG. 3B shows the unit if the invention were not used.

In FIG. 3A, the first argon column 1AR has its base supported above the ground G by a supporting structure S that provides support for the second insulating enclosure or cold box CB2 for the column 1AR. The pump P and the pump motor M are both within the supporting structure S, preferably entirely within the supporting structure S and preferably positioned directly under the column 1AR. The first insulated enclosure CB1 is an insulated enclosure for the pump P on top of which or on the side wall of which the motor M is positioned. This insulated enclosure CB1 is also positioned at least in part within the supporting structure S.

The conduit carrying the liquid 12 to the pump P has a vertical section below column 2AR from which it comes. The conduit then becomes horizontal and comes straight into the first insulating enclosure or cold box CB1 and pump P.

As shown in FIG. 3B, if the second argon column 2AR had been positioned on the supporting structure, the liquid conduit would have a 90° bend within the first insulating enclosure or cold box CB1 for the pump and part of the first insulating enclosure or cold box CB1 would necessarily protrude, increasing the footprint of the overall plant. We see that the pump P and motor are not positioned within the supporting structure S.

Figure 3C:
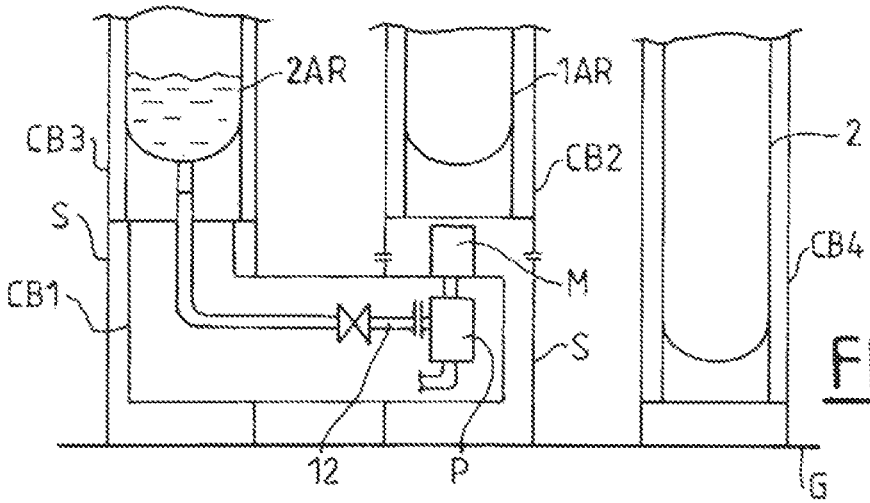

FIG. 3C shows an alternative version of FIG. 3A. As before, the enclosure CB1 is positioned in part below the column 1AR, the pump P and motor M being positioned directly underneath the bottom of 1AR whilst not receiving any liquid to be pumped from column 1AR.

All the liquid to be pumped is removed from the bottom of column 2AR housed in third insulated enclosure CB3. The bottom of column 2AR is in this case elevated above the ground G by supporting structure S. In this case a common supporting structure S is used to support both first and second argon column but it will of course be appreciated that two independent supporting structures could be used.

In this particular case, the liquid from the bottom of second argon column 2AR flows out of the third insulated enclosure CB3 directly into the first insulated enclosure CB1, so that there is no need to insulate the conduit for the liquid between the two insulated enclosures.

Thus the present invention reduces the total footprint of the plant and thus the total cost of the plant. The FIGS. 1 and 2 represent the simplest and cheapest solutions. The example of FIG. 3C shows that it is possible to integrate the enclosures for the two argon columns using a supporting structure in order to eliminate any footprint specifically resulting from the presence of the pump insulating enclosure CB1. In the case of FIG. 3C, the footprint of insulating enclosures CB2 and CB3 alone defines the footprint required for all three insulating enclosures CB1, CB2 and CB3. However, this solution is not optimal from the point of view of cost.

The supporting structure S for all cases can be constructed such that the pump insulating structure CB1 can be inserted into the structure once the structure and possibly at least one of the columns is constructed. In this way it is possible to allow for different delivery dates for the pump P, without holding up the construction of the unit.

The bases of insulating enclosures CB2 and CB3 may or may not be at the same heights.

In the figures, there is some space between the top of first insulated enclosure CB1 and the bottom of the second insulated enclosure CB2. This space may be reduced and the second insulated enclosure may even rest on the first insulated enclosure.

It can also be envisaged that the two insulated enclosures CB1 and CB2 should be fixed together, for example by the supporting structure, to form one transportable module.

It is additionally possible, as shown in FIG. 3C, to transport enclosures CB1, CB2 and CB3 together as a single module.

According to the invention, the pump is positioned underneath a column other than the column that is the source of the liquid to be pumped by the pump. The pump is positioned underneath the column that receives the pumped liquid.

The first end of the second argon column may be at a lower or higher level above the ground that the first end of the first argon column or at the same level.

The second end of the second argon column may be at a lower or higher level above the ground than the second end of the first argon column or at the same level.

Preferably, the second argon column 2AR is positioned between the first argon column 1AR and the double column 1, 2 (or one or both of the columns 1, 2). The first argon column 1AR may alternatively be positioned in the usual manner between second argon column 2AR and the double column 1, 2 (or one or both of the columns 1, 2).

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A pump module configured for use in an air separation plant having one or more rectification columns configured to separate nitrogen and oxygen from a cooled air stream and an argon module containing one or more argon columns, the pump module having a pump, which is configured to deliver a fluid from a lower portion of the argon module to a second location that is at a location disposed higher than the lower portion of the argon module, wherein the pump module is configured to be disposed under the argon module and configured to provide at least partial structural support for the argon module, wherein the pump is contained within a first insulated enclosure, wherein a first argon column is contained within a second insulated enclosure, wherein the first insulated enclosure is contained partially within the first supporting structure and partially within the second insulated enclosure.

2. The pump module of claim 1, wherein the first supporting structure is configured to at least partially support the argon module.

3. The pump module of claim 1, wherein the first insulated enclosure comprises walls surrounding the pump; wherein the walls are thermally insulating and/or a thermally insulating material is at least partially filled between the walls and the pump.

4. An air separation plant comprising one or more rectification columns that are configured for the separation of nitrogen and oxygen from a cooled air stream, an argon module having one or more argon columns; and a pump module, the pump module having a pump, which is configured to deliver a fluid from a lower portion of the argon module to a second location that is at a location disposed higher than the lower portion of the argon module, wherein the pump module is disposed under the argon module and provides at least partial structural support for the argon module, wherein the pump is contained within a first insulated enclosure, wherein a first argon column is contained within a second insulated enclosure, wherein the first insulated enclosure is contained partially within the first supporting structure and partially within the second insulated enclosure.

5. The air separation plant of claim 4, wherein the first supporting structure is arranged under the argon module, wherein the pump module is disposed at least partially with said first supporting structure, so that the first supporting structure is configured to at least partially support the argon module.

6. The air separation plant of claim 4, wherein the first supporting structure has a base that is enclosed within a base of the argon module when viewed in the vertical direction.

7. The air separation plant of claim 4, wherein the argon module comprises walls surrounding at least one of the one or more argon columns; wherein the walls are thermally insulating and/or a thermally insulating material is at least partially filled between the walls and the one or more argon columns.

* * * * *